US008257025B2

(12) United States Patent
Little et al.

(10) Patent No.: US 8,257,025 B2
(45) Date of Patent: Sep. 4, 2012

(54) COMBUSTION TURBINE INCLUDING A DIFFUSER SECTION WITH COOLING FLUID PASSAGEWAYS AND ASSOCIATED METHODS

(75) Inventors: David A. Little, Chuluota, FL (US); Hubertus E. Paprotna, Palm City, FL (US); Kevin M. Light, Maitland, FL (US)

(73) Assignee: Siemens Energy, Inc., Orlando, FL (US)

( * ) Notice: Subject to any disclaimer, the term of this patent is extended or adjusted under 35 U.S.C. 154(b) by 1171 days.

(21) Appl. No.: 12/106,375

(22) Filed: Apr. 21, 2008

(65) Prior Publication Data

US 2009/0263243 A1 Oct. 22, 2009

(51) Int. Cl.
*F01D 9/06* (2006.01)

(52) U.S. Cl. ..... 415/115; 415/182.1

(58) Field of Classification Search ..... 415/914, 415/211.2, 142, 182.1, 224.5
See application file for complete search history.

(56) References Cited

U.S. PATENT DOCUMENTS

| | | | | |
|---|---|---|---|---|
| 2,674,845 | A * | 4/1954 | Pouchot | 415/211.2 |
| 3,885,891 | A * | 5/1975 | Throndson | 417/196 |
| 5,462,088 | A | 10/1995 | Poux et al. | 18/39 |
| 5,603,605 | A | 2/1997 | Fonda-Bonardi | 145/211.2 |
| 5,737,915 | A | 4/1998 | Lin et al. | 60/251 |
| 5,813,828 | A * | 9/1998 | Norris | 415/914 |
| 6,682,021 | B1 | 1/2004 | Truax et al. | 244/201 |
| 6,896,475 | B2 | 5/2005 | Grazioski et al. | 415/1 |
| 6,997,676 | B2 * | 2/2006 | Koshoffer | 415/211.2 |
| 7,617,670 | B2 * | 11/2009 | Truax et al. | 415/914 |

FOREIGN PATENT DOCUMENTS

| | | | |
|---|---|---|---|
| JP | 63105300 A | * | 5/1988 |
| JP | 06137105 A | * | 5/1994 |

OTHER PUBLICATIONS

JP 06-137105 A JPO Machine Translation. Accessed JPO website Jan. 11, 2012.*

JP 63-105300 A English Translation. The McElroy Translation Company. Washington, D.C. Jan. 2012.*

* cited by examiner

*Primary Examiner* — Richard Edgar

(57) ABSTRACT

A combustion turbine includes a compressor section, a combustion section downstream from the compressor section, and a turbine section downstream from the combustion section. A diffuser section is downstream from the turbine section and has an outer wall, an inner wall, and at least one strut member extending therebetween. The outer wall has at least one first gas passageway therein, the inner wall has at least one second gas passageway therein, and the at least one strut member has at least one third gas passageway therein. The at least one first, second and third gas passageways deliver gas therethrough to assist attachment of a boundary layer to adjacent surfaces of the outer wall, the inner wall, and the at least one strut, respectively.

17 Claims, 4 Drawing Sheets

COMBUSTION TURBINE INCLUDING A DIFFUSER SECTION WITH COOLING FLUID PASSAGEWAYS AND ASSOCIATED METHODS

FIELD OF THE INVENTION

The present invention relates to the field of combustion turbines, and, more particularly, to a combustion turbine including a diffuser section and associated methods.

BACKGROUND OF THE INVENTION

A combustion turbine typically includes, in a serial flow relationship, a compressor section to compress the entering airflow, a combustion section in which a mixture of fuel and the compressed air is burned to generate a propulsive gas flow, and a turbine section that is rotated by the propulsive gas flow. After passing through the turbine section, the propulsive gas flow exits the engine through a diffuser section. In ground based combustion turbines used for electricity generation, power is normally extracted from the rotating shaft to drive an electrical power generator.

The efficiency of a combustion turbine is related to the combustion temperature. In the pursuit of greater combustion turbine efficiency, components formed from new materials are desired to withstand the increased temperatures that often accompany an increase in efficiency. Likewise, new cooling methods are desired to cool the components.

An exhaust diffuser section of a ground based combustion turbine is commonly subjected to temperatures in excess of 1000° Fahrenheit. One approach to improving diffuser performance, the insertion of vortex generators into the diffuser, is disclosed in U.S. Pat. No. 6,682,021 to Truax et al. Vortex generators may need a high momentum fluid flow to re-energize the boundary layer and enhance attachment. Since the fluid flow may slow as it travels from the diffuser inlet to the diffuser outlet, the fluid flow available to a vortex generator closer to the diffuser outlet may be unable to sufficiently re-energize the boundary layer to prevent separation.

U.S. Pat. No. 6,896,475 to Graziosi et al., for example, discloses a diffuser for a gas turbine having an outer wall, a centerbody, and a strut extending therebetween. The outer wall and centerbody each have an opening, in the vicinity of the diffuser inlet. The gas turbine directs a steady stream of fluid from an upstream turbine stage to the openings to prevent or delay boundary layer separation.

Another approach is presented in U.S. Pat. No. 5,603,605 to Fonda-Bonardi, which discloses the placement of a capture scoop located in the vicinity of the outlet of a diffuser section of an axial gas turbine. Fluid collected by the capture scoop is fed to a plurality of slots in the inner and outer walls of the diffuser section to re-energize the boundary layer. The slots of this approach may not be able to deliver enough fluid to re-energize the boundary layer at all points and prevent detachment because the volume of fluid delivered through the slots depends upon the volume of the fluid in the diffuser.

SUMMARY OF THE INVENTION

In view of the foregoing background, it is therefore an object of the present invention to provide a combustion turbine having a diffuser section with enhanced cooling performance.

This and other objects, features, and advantages in accordance with the present invention are provided by a combustion turbine comprising a compressor section, a combustion section downstream from the compressor section, and a turbine section downstream from the combustion section. A diffuser section may be downstream from the turbine section and may comprise an outer wall, an inner wall, and at least one strut member extending therebetween. The outer wall may have at least one first gas passageway therein, the inner wall may have at least one second gas passageway therein, and the at least one strut member may have at least one third gas passageway therein.

The at least one first, second and third gas passageways may deliver gas therethrough to assist and enhance attachment of a boundary layer to adjacent surfaces of the outer wall, the inner wall and the at least one strut, respectively. This enhanced boundary layer attachment provides enhanced cooling of the diffuser surfaces.

The diffusion section may include at least one valve for selectively controlling a flow of gas to at least one of the first, second, and third gas passageways. Furthermore, a controller may control the at least one valve. Moreover, the diffusion section may also include at least one pressure sensor and the controller may control the at least one valve based upon the at least one pressure sensor. The sensor may allow detection of the detachment of the boundary layer from the diffuser surfaces and the controller may control the valve to reattach the boundary layer to the diffuser surfaces. Alternatively, the controller may also control the at least one valve based upon stored control values.

The at least one first and second gas passageways may each comprise a plurality of gas passageways. The at least one strut member may have left and right hand sides. Moreover, the at least one third gas passageway may comprise a plurality of third gas passageways with at least one on each of the left and right hand sides of the at least one strut member. Additionally, a gas source may be coupled in fluid communication with the gas passageways.

Another aspect is directed to a method of making a diffusion section for a combustion turbine so that surfaces of the diffusion section have enhanced attachment of a boundary layer adjacent thereto. The diffusion section may comprise an outer wall, an inner wall, and at least one strut member extending therebetween. The method may include forming at least one first gas passageway in the outer wall, forming at least one second gas passageway in the inner wall, and forming at least one third gas passageway in the at least one strut member. The at least one first, second, and third gas passageways may be configured to deliver gas therethrough to thereby provide enhanced attachment of a boundary layer to adjacent surfaces of the diffusion section.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation is used to indicate similar elements in alternative embodiments.

Figure 1:
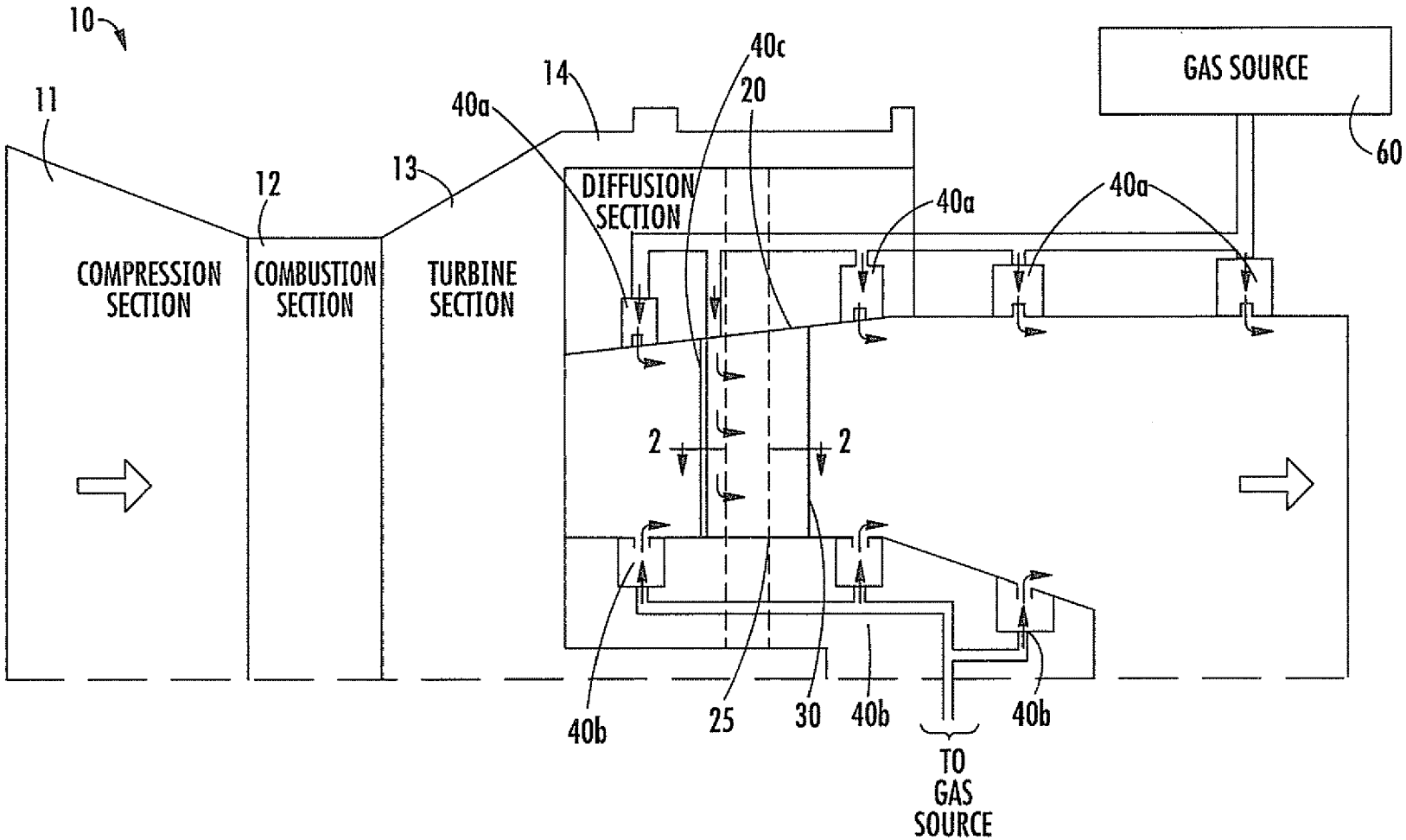
FIG. 1 is a schematic longitudinal cross sectional view of a combustion turbine in accordance with the present invention.
Figure 2:
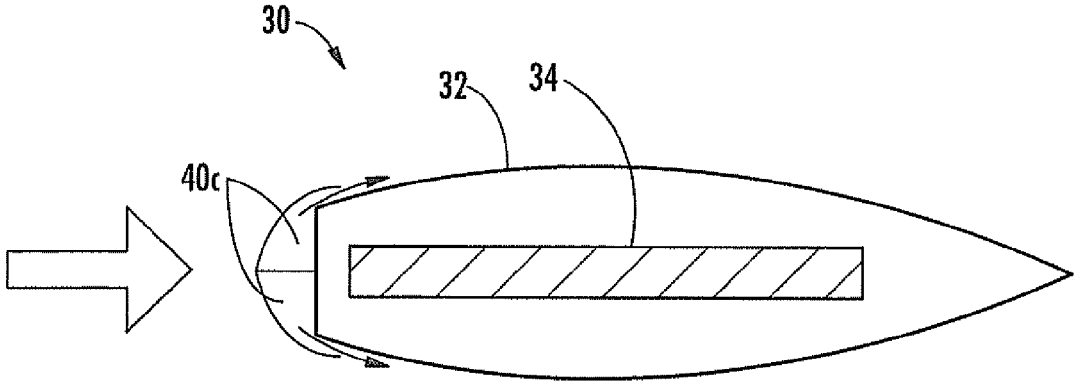
FIG. 2 is a schematic cross sectional view of the strut member taken along line 2-2 of FIG. 1.

Referring initially to FIGS. 1 and 2, a first embodiment of a combustion turbine 10 is now described. The combustion turbine 10 illustratively comprises a compressor section 11, a combustion section 12 downstream from the compressor section, and a turbine section 13 downstream from the combustion section. A diffuser section 14 is downstream from the turbine section 13.

The diffuser section 14 includes an inner wall 25 and an outer wall 20. The diffuser section 14 also includes a strut member 30. The strut member 30 comprises a strut cover 32, and a strut 34 within the strut cover. It will be appreciated by those skilled in the art that the strut cover 32 can be any shape and that, in some embodiments, the strut member 30 might include multiple struts 34. For clarity of explanation, only a single strut member 30 is shown, and those of skill in the art will recognize that multiple strut members may also be included in the diffuser section 14.

The outer wall 20 illustratively has a plurality of first gas passageways 40*a*, and the inner wall 25 illustratively has a plurality of second gas passageways 40*b*. The strut member 30 also has a plurality of third gas passageways 40*c*. The gas passageways 40*a*, 40*b*, 40*c* deliver gas therethrough to assist attachment of the boundary layer to the respective surfaces adjacent the gas passageways. This enhanced boundary layer attachment provides enhanced cooling of the diffuser surfaces.

It will be appreciated by those skilled in the art that, in some embodiments, the outer wall 20, inner wall 25, and strut member 30 may each have one gas passageway 40*a*-40*c* or any number of gas passageways. Likewise, the outer wall 20, inner wall 25, and strut member 30 need not each have the same number of gas passageways 40*a*-40*c*. The gas passageways 40*a*-40*c* can be located at spaced apart locations in the diffuser section 14.

The gas passageways 40*a*-40*c* may be any shape, for example, holes or slots. Moreover, the gas passageways 40*a*-40*c* need not each be the same shape. For example, some may be slots, some may be circular holes, and some may be oval holes.

As shown in FIG. 2, the strut or third gas passageways 40*c* may be in the form of left and right handed slotted passageways, with each being selectively operable as will be described below with respect to other embodiments. This left or right handed slot passageway selection depends on the operating regime and the resultant side that requires gas flow, as will be appreciated by those skilled in the art.

A gas source 60 is illustratively coupled in fluid communication with the gas passageways 40*a*-40*c*. The gas source 60 can be an external pump. In other embodiments, the gas source 60 is a fluid line extracting air from a port in the compressor section 11 and feeding the extracted air to the gas passageways 40*a*-40*c*. In some embodiments, the gas passageways 40*a*-40*c* may be coupled to a plenum, and the gas source 60 is coupled in fluid communication with the plenum as will be appreciated by those skilled in the art.

Figure 3:
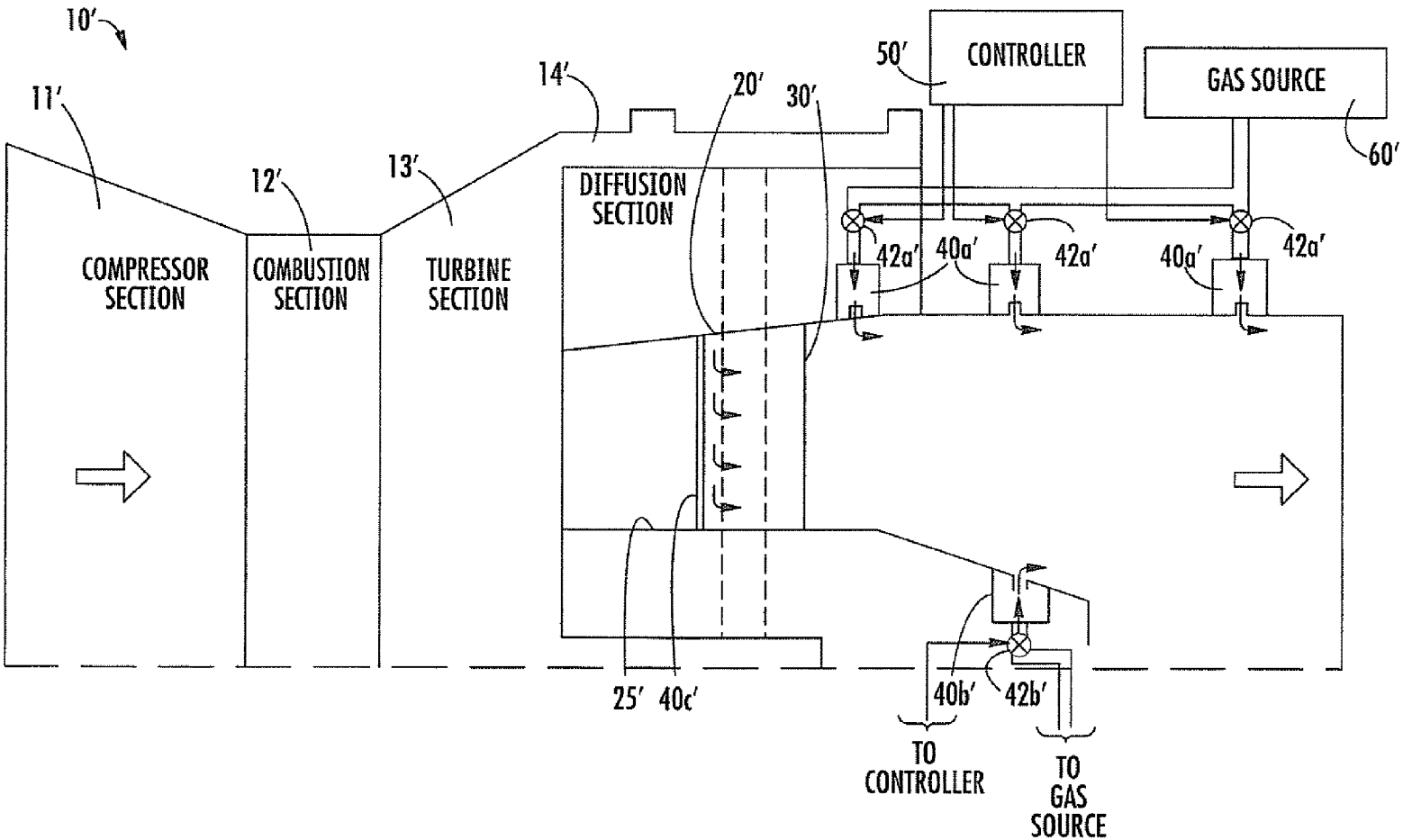
FIG. 3 is a schematic longitudinal cross sectional view of another embodiment of a combustion turbine in accordance with the present invention.

Turning now to FIG. 3, in an alternative embodiment, the diffusion section 14' includes first valves 42*a*' to selectively control the flow of gas to the first gas passageways 40*a*', a second valve 42*b*' to selectively control the flow of gas to the second gas passageway 40*b*', and a third valve (not shown in FIG. 3), collectively referred to as valves 42' in the present example and valves 42" in the example of FIG. 4 below, to selective control the flow of gas to the third gas passageway 40*c'*.

It is to be understood that, in some embodiments, each of the gas passageways 40*a*'-40*c*' can include any number of valves 42' and that some gas passageways may have valves while other gas passageways do not. The valves 42' can comprise any type of valve as will be understood by those skilled in the art.

A controller 50' is illustratively coupled to the valves 42'. In the illustrated embodiment, the controller 50' controls the valves 42' based upon stored control values. The stored control values may be determined during manufacturing or upon initial installation of the combustion turbine 10' as will be appreciated by those skilled in the art. The controller 50' may continuously control the valves 42' or may control the valves at discrete times. In some embodiments, the controller 50' may control only some of the valves 42'. Those other elements are similar to those discussed above and require no further discussion herein.

Figure 4:
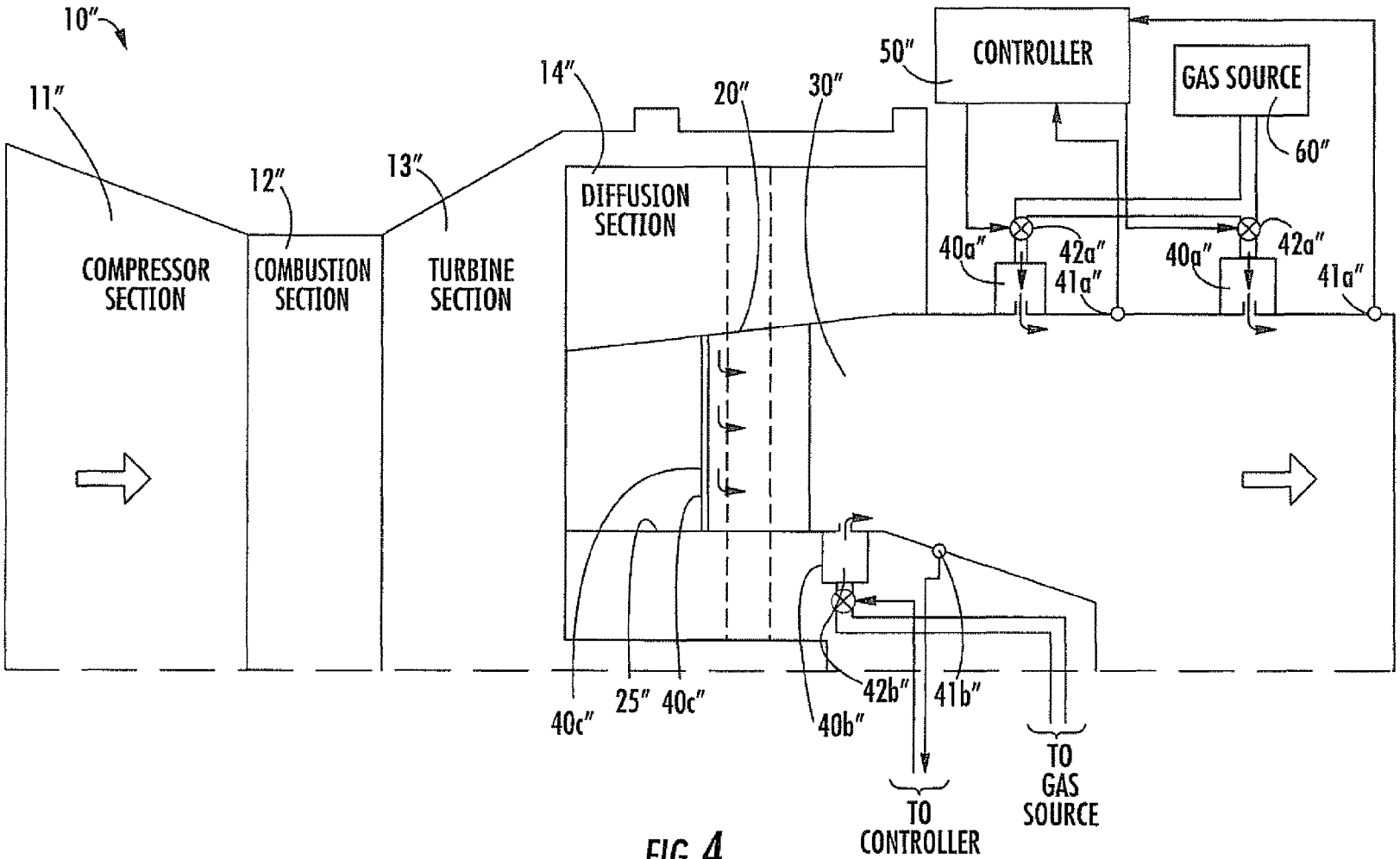
FIG. 4 is a schematic longitudinal cross sectional view of yet another embodiment of a combustion turbine in accordance with the present invention.

Referring now additionally to FIG. 4, yet another embodiment of the diffusion section 14" includes respective pressure sensors 41*a*", 41*b*" and a pressure sensor associated with the strut member 30" (not shown in FIG. 4), collectively referred to as pressure sensors 41" below, to measure different pressures in the diffuser section 14". Moreover, in some embodiments, the outer wall 20", the inner wall 25", and the strut member 30" could each have any number of pressure sensors 41" mounted thereto. In such embodiments, the outer wall 20", the inner wall 25", and the strut member 30" need not each have the same number of pressure sensors 41". The pressure sensors 41" may measure static pressure, dynamic pressure, or any other pressure. Moreover, the pressure sensors 41" may be any type of pressure sensor as will be understood by those skilled in the art.

A controller 50" is coupled to the valves 42" and the pressure sensors 41". The controller 50" controls the valves 42" based upon the readings of the pressure sensors 41". In some embodiments, the controller 50" may control some of the valves based upon the readings of the pressure sensors 41" while controlling other valves based upon stored control values or based upon an external input.

The controller 50" may continuously control the valves 42" to maintain certain pressures at the sensors 41" or may control the valves at discrete moments in response to a pressure drop or detected boundary layer separation.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A combustion turbine comprising:

a compressor section, a combustion section downstream from said compressor section, and a turbine section downstream from said combustion section; and a diffuser section downstream from said turbine section and comprising an outer wall, an inner wall, and at least one strut member extending therebetween;

said outer wall having at least one first gas passageway therein;

said inner wall having at least one second gas passageway therein;

said at least one strut member having left and right hand sides and a plurality of third gas passageways in said at least one strut member with at least one third gas passageway on each of the left and right hand sides of the at least one strut member;

the at least one first, second and third gas passageways delivering gas therethrough to assist attachment of a boundary layer to adjacent surfaces of said outer wall, said inner wall and said at least one strut, respectively, and the at least one left hand side third gas passageway and the at least one right hand side third gas passageway being selectively operable to provide different amounts of gas flow on the left and right hand sides of said at least one strut member.

2. A combustion turbine according to claim 1 wherein said diffusion section further comprises at least one valve for selectively controlling a flow of gas to at least one of the first, second and third gas passageways.

3. A combustion turbine according to claim 2 wherein said diffusion section further comprises a controller for controlling said at least one valve.

4. A combustion turbine according to claim 3 wherein said diffusion section further comprises at least one pressure sensor; and wherein said controller controls said at least one valve based upon said at least one pressure sensor.

5. A combustion turbine according to claim 3 wherein said controller controls said at least one valve based upon stored control values.

6. A combustion turbine according to claim 1 wherein the at least one first gas passageway comprises a plurality of first gas passageways.

7. A combustion turbine according to claim 1 wherein the at least one second gas passageway comprises a plurality of second gas passageways.

8. A combustion turbine according to claim 1 further comprising a gas source coupled in fluid communication with the at least one first, second and third gas passageways.

9. A diffusion section for a combustion turbine comprising:

an outer wall, an inner wall, and at least one strut member extending therebetween;

said outer wall having at least one first gas passageway therein;

said inner wall having at least one second gas passageway therein;

said at least one strut member having at least one left and right hand sides and a plurality of third gas passageways in said at least one strut member with at least one third gas passageway on each of the left and right hand sides of the at least one strut member;

the at least one first, second and third gas passageways delivering gas therethrough to assist attachment of a boundary layer to adjacent surfaces of said outer wall, said inner wall, and said at least one strut, respectively, and the at least one left hand side third gas passageway and the at least one right hand side third gas passageway being selectively operable to provide different amounts of gas flow on the left and right hand sides of said at least one strut member.

10. A diffusion section according to claim 9 further comprising at least one valve for selectively controlling a flow of gas to at least one of the first, second and third gas passageways.

11. A diffusion section according to claim 10 further comprising a controller for controlling said at least one valve.

12. A diffusion section according to claim 11 further comprising at least one pressure sensor; and wherein said controller controls said at least one valve based upon said at least one pressure sensor.

13. A diffusion section according to claim 11 wherein said controller controls said at least one valve based upon stored control values.

14. A method of making a diffusion section for a combustion turbine so that surfaces of the diffusion section have enhanced attachment of a boundary layer adjacent thereto, the diffusion section comprising an outer wall, an inner wall, and at least one strut member extending therebetween, the method comprising:

forming at least one first gas passageway in the outer wall;

forming at least one second gas passageway in the inner wall;

forming a plurality of third gas passageways in the at least one strut member with at least one third gas passageway on each of left and right hand sides of the at least one strut member; and configuring the at least one first, second, and third gas passageways to deliver gas therethrough to thereby provide enhanced attachment of a boundary layer to adjacent surfaces of the diffusion section, and configuring the at least one left hand side third gas passageway and the at least one right hand side third gas passageway to be selectively operable to provide different amounts of gas flow on the left and right hand sides of the at least one strut member.

15. A method according to claim 14 further comprising selectively controlling a flow of gas to at least one of the first, second and third gas passageways using at least one valve.

16. A method according to claim 15 further comprising positioning at least one pressure sensor in the diffusion section; and wherein selectively controlling the flow of gas comprises selectively controlling the flow of gas based upon the at least one pressure sensor.

17. A method according to claim 15 wherein selectively controlling the flow of gas comprises selectively controlling the flow of gas based upon stored control values.

* * * * *